US007159246B2

(12) United States Patent
Tippey

(10) Patent No.: US 7,159,246 B2
(45) Date of Patent: Jan. 9, 2007

(54) GLOVE WITH HIGH TACTILE PORTION

(75) Inventor: Darold D. Tippey, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 147 days.

(21) Appl. No.: 10/738,365

(22) Filed: Dec. 17, 2003

(65) Prior Publication Data

US 2005/0132467 A1 Jun. 23, 2005

(51) Int. Cl.
*A41D 19/00* (2006.01)

(52) U.S. Cl. ..... 2/163; 2/159

(58) Field of Classification Search ..... 2/163, 2/168, 161.8, 21, 64, 60, 16, 159, 161, 161.2, 2/160, 162, 161.7
See application file for complete search history.

(56) References Cited

U.S. PATENT DOCUMENTS 3,881,197 A * 5/1975 Andrews ..... 2/161.8
4,416,026 A 11/1983 Smith
4,507,807 A 4/1985 Karkanen
4,964,174 A * 10/1990 Martin ..... 2/161.8
5,070,543 A * 12/1991 Beck ..... 2/163
5,112,900 A 5/1992 Buddenhagen et al.
5,442,816 A * 8/1995 Seketa ..... 2/161.7
5,548,844 A 8/1996 Ceresia
5,900,452 A 5/1999 Plamthottam
6,029,276 A * 2/2000 White ..... 2/161.6

OTHER PUBLICATIONS

Abstract of Japanese Patent. No. JP01158946, Jun. 22, 1989.
Search Report and Written Opinion for PCT/US2004/017635, Nov. 29, 2004.

* cited by examiner

*Primary Examiner*—Gary L. Welch
*Assistant Examiner*—Richale L. Haney
(74) *Attorney, Agent, or Firm*—Dority & Manning

(57) ABSTRACT

A protective glove configured to cover the hand of the user is provided. The glove includes a first portion that is configured for tightly fitting on at least a portion of the hand of the user. A second portion is contiguous with the first portion and is also configured for tightly fitting on at least a portion of the hand of the user. The second portion has a higher tactility than the first portion so that the user of the glove may more easily feel through the second portion than through the first portion.

8 Claims, 4 Drawing Sheets

GLOVE WITH HIGH TACTILE PORTION

BACKGROUND

Gloves formed of elastic materials find applicability in a variety of applications. These types of gloves may be used as surgical gloves, examination gloves, dishwashing gloves, food service gloves, and the like. Some gloves are designed to be stretched to some degree during normal use. For example, gloves configured as surgical and examination gloves are formed so as to be stretched during donning in order to fit tightly against the hand and provide beneficial gripping and tactile characteristics during use. Gloves have proven to be an effective barrier between the user's hand and the environment, successfully protecting both from cross-contamination.

An exemplary medical procedure that involves the use of gloves is drawing blood samples from a patient. This procedure requires a healthcare provider to locate a blood vein in the patient's arm which may be tapped in order to remove blood from the patient. Locating a vein may be difficult while wearing gloves in that the gloves decrease finger sensitivity because the glove covers the healthcare provider's fingers. One common practice in drawing blood from a patient is for the healthcare provider to rip one finger stall off of the glove in order to expose his or her fingertip. In this manner, the healthcare provider may directly contact the patient's skin in order to more easily locate a vein in the patient's arm. This practice leaves the healthcare provider's finger exposed to possible infected blood contamination.

In the past, designers have constructed gloves having a plurality of openings located at various locations on the glove in order to provide direct contact at these locations. Again, this type of configuration is disadvantagous in that a portion of the user's hand is exposed to possible contamination.

Prior gloves have also been designed with a loose fitting, thicker, tougher material comprising the majority of the glove while the fingertips of the glove are made from a material that provides for a higher tactility. These types of gloves require a high friction element to be incorporated therein in order to retain the portion having the higher tactility on the fingertips of the user. Additionally, the relatively loose fitting, thicker, tougher material that makes up the rest of the glove suffers from poor gripping and tactile characteristics.

The present invention provides for an improved protective glove that has a higher tactility portion so that the user may more easily feel through the glove.

SUMMARY

Various features and advantages of the invention will be set forth in part in the following description, or may be obvious from the description.

The present invention provides a protective glove that is configured to cover the hand of the user. The glove includes a first portion that is configured for tightly fitting on at least a portion of the hand of the user, and a second portion that is contiguous with the first portion. The second portion is likewise configured for tightly fitting on at least a portion of the hand of the user and has a higher tactility than the first portion. This characteristic allows a user to more easily feel through the second portion than through the first portion.

The glove may be constructed in order to include a body portion that has a thumb, index, middle, ring, and pinky finger stall connected thereto. The finger stalls are each configured for covering their respective finger of the user. The second portion may be incorporated into any number of the finger stalls. For instance, the second portion may be incorporated into the index finger stall in order to cover a portion of the tip of the index finger of the user, while the first portion makes up the rest of the glove.

The present invention also provides a protective glove as set forth above that has a first orientation where the first portion covers the second portion. The glove may be moved into a second orientation where the second portion is exposed from under the first portion so that the first portion now covers less of the hand of the user. The glove may define a slit on the backside of the index finger stall in the first orientation. In the section orientation, the user may pull the first portion at the slit so that the first portion is pulled off of the tip of the index finger of the user to expose the second portion. The second orientation is advantageous in that the first portion protects the majority of the hand of the user, and the second portion protects the tip of the index finger of the user while providing a higher tactility to afford the user of the glove greater sensitivity.

The present invention also provides for exemplary embodiments as discussed above wherein the first portion and the second portion may be configured in a variety of manners. For instance, the second portion may be incorporated into the entire index finger stall, while the first portion is incorporated into the rest of the glove. Alternatively, all of the finger stalls may be made of the second portion, while the body portion of the glove is made of the first portion. It is also possible to have the tips of the index, middle, ring, and pinky finger stalls all made of the second portion, while the rest of the glove is made of the first portion.

The glove may be constructed in a variety of manners so that the second portion is of a higher tactility than the first portion. For instance, in accordance with one exemplary embodiment of the present invention the second portion may be made of polypropylene, and the first portion may be made from nitrile, natural rubber latex, silicone, polyurethane, and/or a thermoplastic/elastomer. The second portion may be of a different type of material than the first portion, specifically one having a higher tactility than the first portion. Additionally or alternatively, the second portion may be thinner than the first portion so that it is easier for the user to feel through the second portion, hence providing the second portion with a higher tactility than the first portion.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
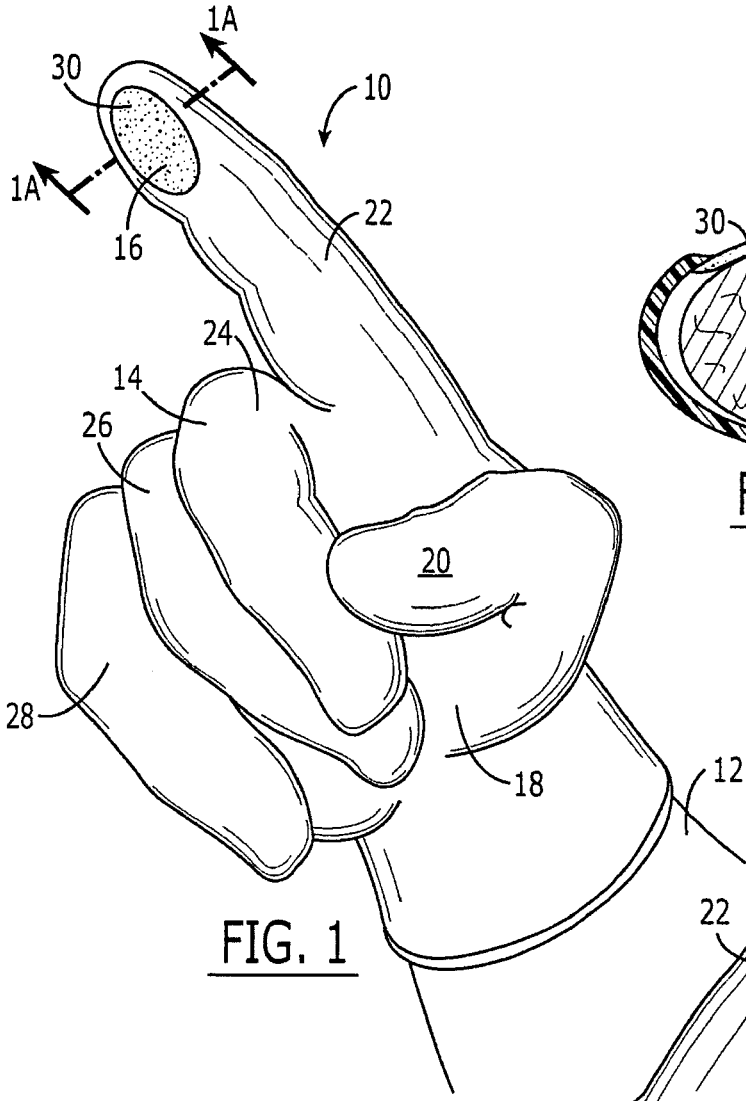
FIG. 1 is a perspective view of a glove in accordance with one exemplary embodiment of the present invention. The tip of the index finger stall is made of a second portion, while the rest of the glove is made of a first portion.
Figure 1A:
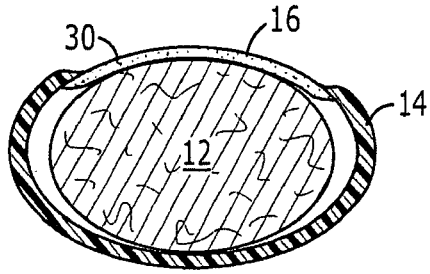
FIG. 1A is a cross-sectional view taken along line 1A of FIG. 1.

Repeat use of reference characters throughout the present specification and appended drawings is intended to represent same or analogous features or elements of the invention.

DETAILED DESCRIPTION

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

The present invention is not limited to the numerical ranges and limits discussed herein. For example, a range of from about 100 to about 200 also includes ranges from about 110 to about 190, about 140 to about 160, and from 131 to 145. As a further example, a numerical limit of less than about 10 also includes a numerical limit of less than about 7, less than about 5, and less than about 3.

Referring to FIG. 1 in general, the present invention provides for a glove 10 that is configured for fitting over the hand 12 of a user. The glove 10 includes a first portion 14 that is configured for tightly fitting on at least a portion of the hand 12 of the user. Additionally, the glove 10 includes a second portion 16 that is also configured for tightly fitting on at least a portion of the hand 12 of the user. The first and second portions 14, 16 are attached to one another. The second portion 16 has a higher tactility than the first portion 14 so that the user of the glove 10 may more easily feel through the second portion 16 than the first portion 14.

The glove 10 of the present invention may be used in any application in which the user desires to cover his or her hands 12. For instance, the glove 10 may be used while working in the medical field, conducting biological research, working with hazardous materials, performing acid etching, working in the art field, etc.

In the exemplary embodiment of FIG. 1, the glove 10 includes a first portion 14 that covers the majority of the hand 12 of the user. The first portion 14 includes a body portion 18 that fits around the palm and the back of the hand of the user. Attached to or formed integrally with the body portion 18 are a plurality of finger stalls, namely a thumb finger stall 20, an index finger stall 22, a middle finger stall 24, a ring finger stall 26, and a pinky finger stall 28.

The first portion 14 contacts a majority of the skin of the hand 12 and is typically more difficult to don and remove from the hand 12 of the user due to the tight fitting engagement. However, it is to be understood that some degree of looseness is present in the fit between the first portion 14 and the hand 12, for example areas between the finger stalls 20, 22, 24, 26, and 28 and areas proximate to the wrist of the user may in some instances be of a looser fit. However, the first portion 14 is configured overall for tightly fitting against at least a portion of the hand 12 of the user. This type of fit allows for a protective barrier to exist between the hand 12 and the environment, and at the same time provides for a minimal hindrance in allowing the user to accomplish his or her work.

A second portion 16 is included and is contiguous with the first portion 14. The second portion 16 may be contiguous by being either a separate component attached to, or alternatively integrally formed with the first portion 14. The second portion 16 is incorporated into a tip 30 of the index finger stall 22. The second portion 16 is of a higher tactility than the first portion 14 such that the user may more easily feel through the second portion 16 than the first portion 14. In this manner, the user may more easily perform a particular task requiring a certain degree of feeling by the user. This type of task may be using the tip of his or her index finger to successfully locate a vein in a patient's arm for the purpose of drawing blood or starting an IV. The configuration shown in FIG. 1 therefore allows for the entire hand 12 of the user to be protected, while at the same time allowing for a portion of the hand 12 (i.e., a fingertip) to have increased sensitivity brought about by wearing of the glove 10.

Figure 2A:
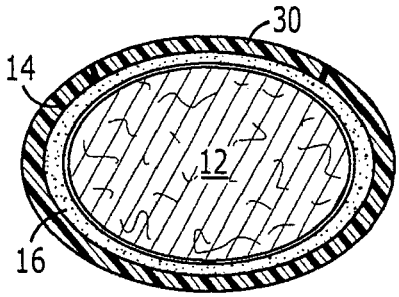
FIG. 2A is a cross-sectional view taken along line 2A of FIG. 2.
Figure 2:
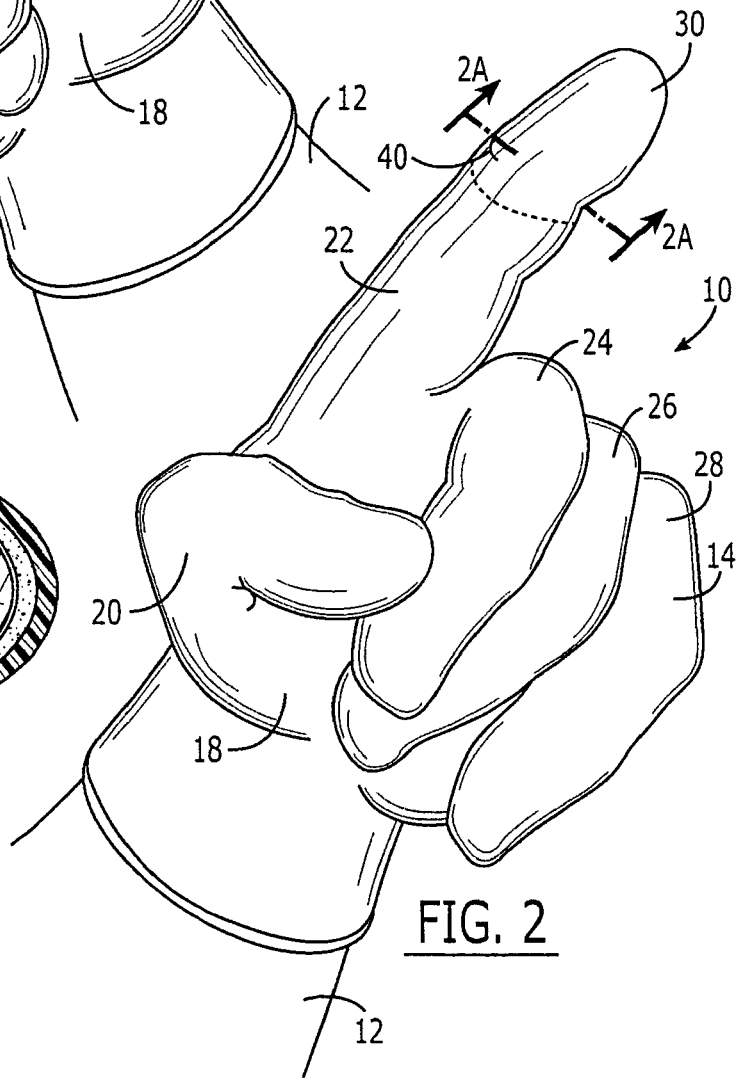
FIG. 2 is a perspective view of a glove in accordance with one exemplary embodiment of the present invention shown in a first orientation. Here, the first portion covers the entire hand of the user.
Figure 3:
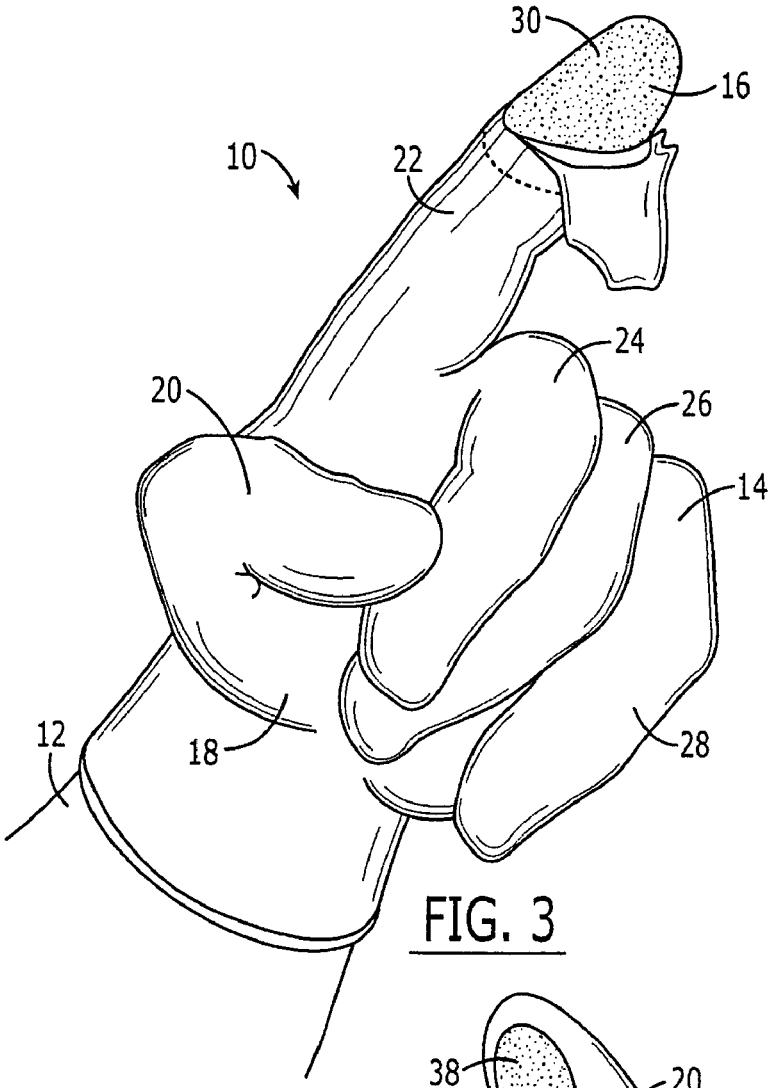
FIG. 3 is a perspective view of the glove shown in FIG. 2. Here, the glove is in a second orientation in which a part of the first portion is removed from the tip of the index finger stall so that the second portion covers the tip of the index finger stall.

The glove 10 may also be configured in accordance with other exemplary embodiments of the present invention to have a first and second orientation. For instance, FIG. 2 shows an exemplary embodiment where the glove 10 is in a first orientation, the first portion 14 covering the entire hand 12 of the user. Placement into this first orientation is advantageous in that the protective properties of the first portion 14 will be utilized across the entire surface of the user's hand 12. A slit 40, in one exemplary embodiment being about 10 mm in length, is provided on the backside of the index finger stall 22. As shown in FIG. 3, the user may reorient the glove 10 into the second orientation by pulling the first portion 14 at the slit 40 and removing the first portion 14 from the tip 30 of the index finger stall 22. This causes the second portion 16 to be exposed, which covers the tip of the index finger of the user's hand 12. The second portion 16 may cover some or all of the user's index finger, and the entire second portion 16 need not be exposed. In such an orientation, the user benefits from the higher tactility of the second portion 16 and may more easily feel objects or surfaces through the tip of his or her index finger. Once this greater sensitivity is no longer required, the user may reorient the glove 10 by pulling the first portion 14 over the tip 30 of the index finger stall 22 so that the glove 10 is once again repositioned into the first orientation.

Figure 4:
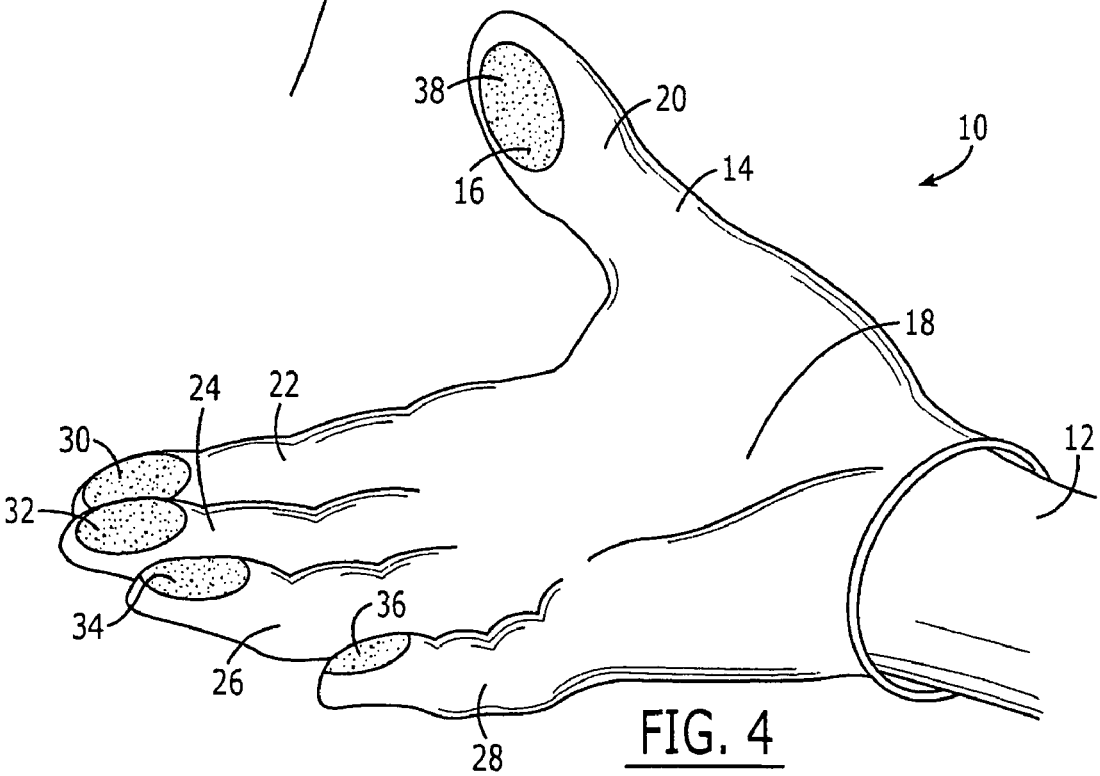
FIG. 4 is a perspective view of a glove in accordance with one exemplary embodiment of the present invention. The tips of the glove are made of a higher tactile second portion while the rest of the glove is made of a lower tactile first portion.

The first and second portions 14, 16 of the glove 10 may be configured in a variety of manners in accordance with various exemplary embodiments of the present invention. As shown in FIG. 4 for instance, the second portion 16 may cover the tip 30 of the index finger stall 22, the tip 32 of the middle finger stall 24, the tip 34 of the ring finger stall 26, the tip 36 of the pinky finger stall 28, and the tip 38 of the thumb finger stall 20. The first portion 14 makes up the rest of the glove 10. In this manner, the user may have increased sensitivity at his or her fingertips, as opposed to other portions of the hand 12 which are covered by the first portion 14.

Figure 5:
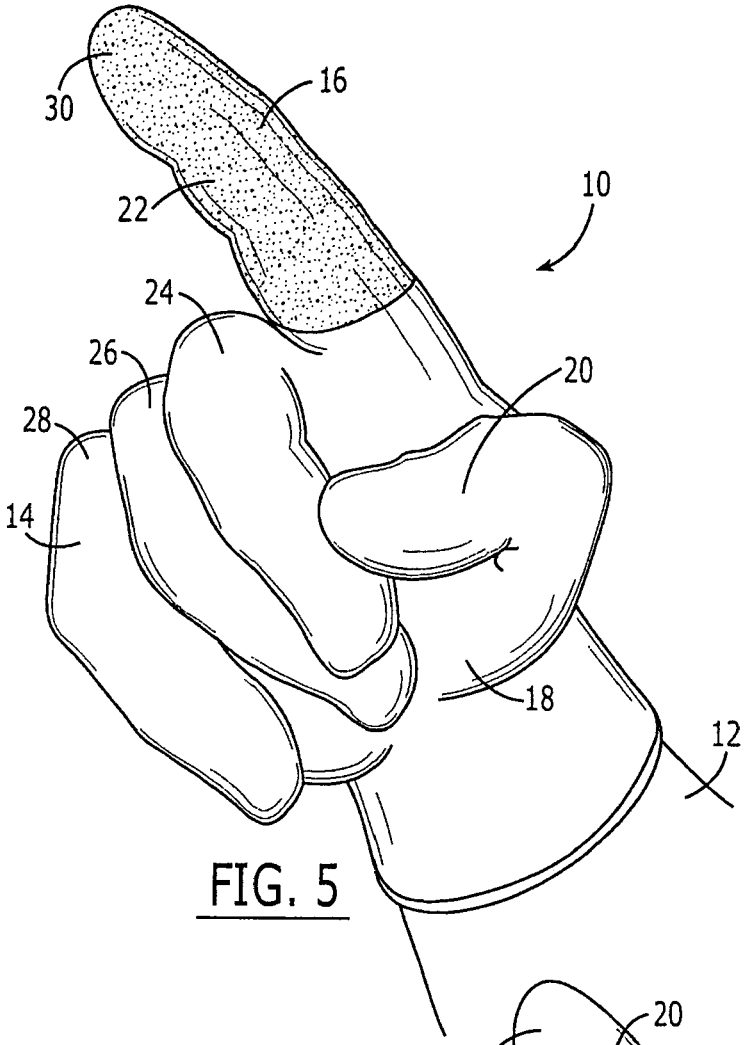
FIG. 5 is a perspective view of a glove in accordance with one exemplary embodiment of the present invention. The index finger stall is made of a higher tactile second portion, while the rest of the glove is made of a lower tactile first portion.
Figure 6:
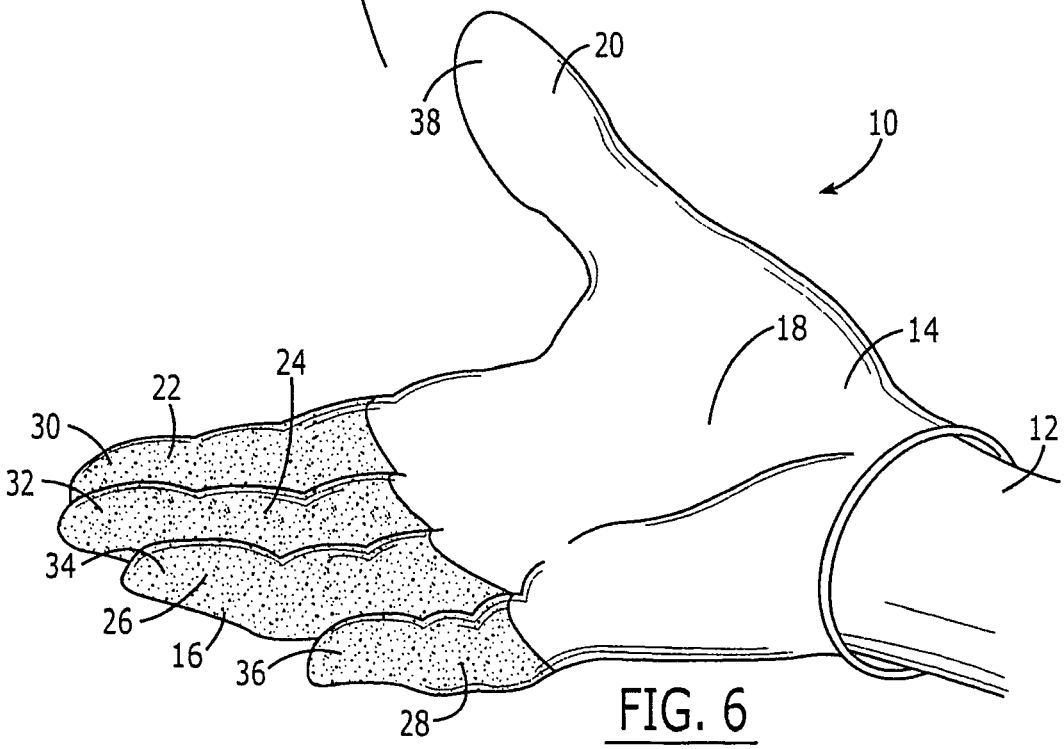
FIG. 6 is a perspective view of a glove in accordance with one exemplary embodiment of the present invention. The index, middle, ring, and pinky finger stalls are made of a higher tactile second portion, while the rest of the glove is made of a lower tactile first portion.

In an alternative exemplary embodiment of the present invention, an entire finger stall may be made of the second portion 16. FIG. 5 shows one such embodiment where the entire index finger stall 22 is made of the second portion 16, while the rest of the glove 10 is made up of the first portion 14. Alternatively, any number of the finger stalls may be made entirely of the second portion 16. Such an exemplary embodiment is shown in FIG. 6 in which the index finger stall 22, middle finger stall 24, ring finger stall 26, and the pinky finger stall 28 are made of the second portion 16. In this instance, the body portion 18 and the thumb finger stall 20 are made of the first portion 14.

Figure 7:
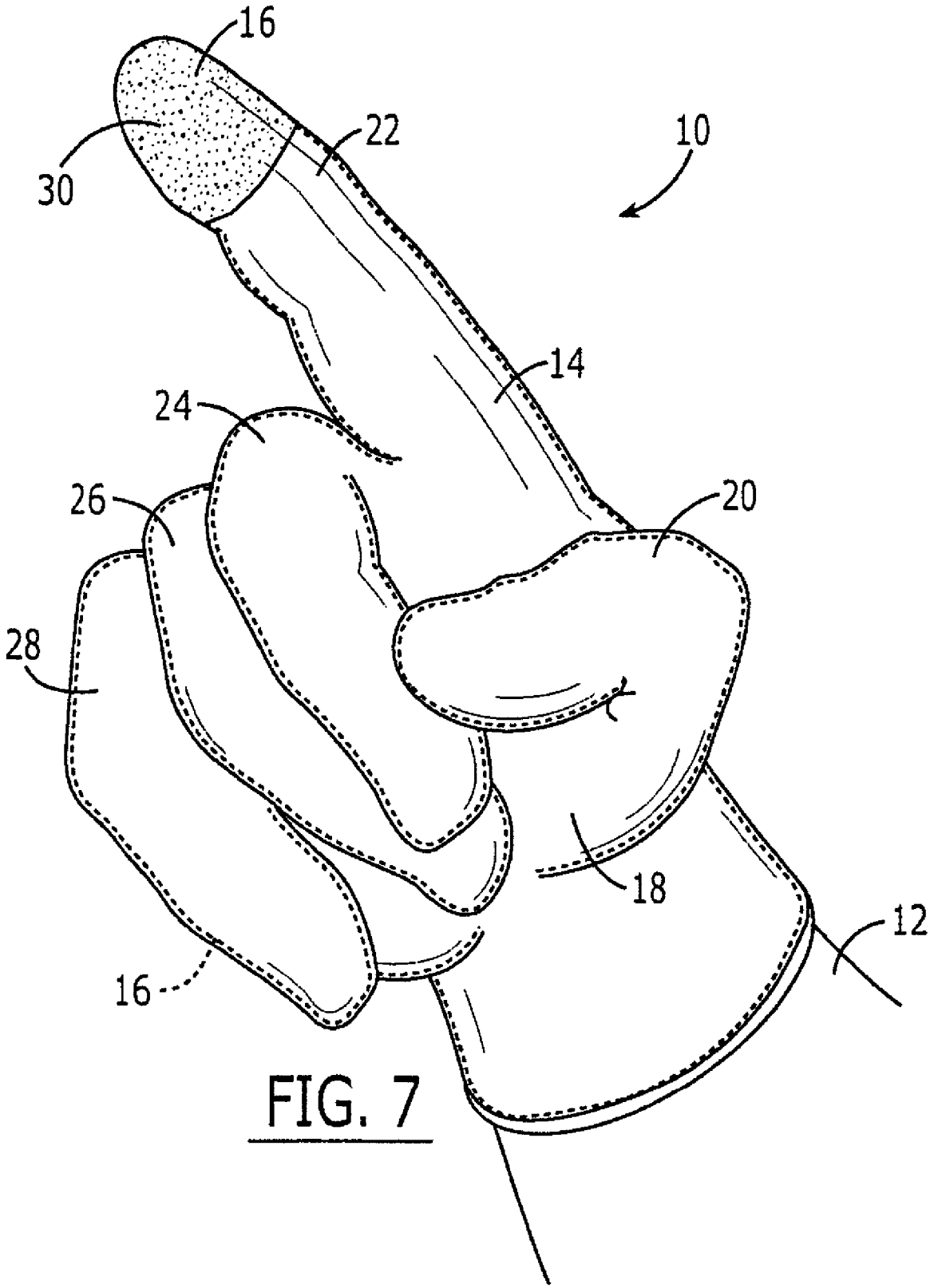
FIG. 7 is a perspective view of a glove in accordance with one exemplary embodiment of the present invention. Here, the higher tactile second portion covers the entire hand of the user, while the lower tactile first portion covers approximately all of the second portion.

FIG. 7 shows an exemplary embodiment of the present invention where the second portion 16 covers the entire hand 12 of the user. The first portion 14 covers the second portion 16 and also covers the entire hand 12 of the user except for the tip of the user's index finger. This exemplary embodiment is similar to that discussed above with respect to FIG. 1. The difference lies in the fact that the second portion 16 acts essentially as a second layer of the glove 10, also covering portions of the user's hand 12 that are covered by the first portion 14. This type of a configuration may be advantageous from a manufacturing standpoint in that the first and second portions 14, 16 are essentially two layers of the entire glove 10.

The attachment between the first portion 14 and the second portion 16 may be made by any method commonly known to those skilled in the art. In accordance with various exemplary embodiments of the present invention, the first and second portions 14, 16 are attached to one another through ultrasonic bonding, adhesives, heat and pressure, and/or microwave bonding. Alternatively or additionally, the first and second portions 14, 16 may be attached to one another through vulcanization or sewing. The glove 10 may be a form fitting slip-on glove. Alternatively, the glove 10 may be provided with a side actuated fastener should the glove 10 be configured as a split glove.

The second portion 16 may be provided so as to be more tactile than the first portion 14 by any manner commonly known to those skilled in the art. The first portion 14 may be thicker than the second portion 16 so that the second portion 16 is of a higher tactility. The second portion 16 may have a higher flexibility or be softer than the first portion 14 so that the second portion 16 has a higher tactility than the first portion 14. Further, the material making up the second portion 16 may be different than the material that makes up the first portion 14. In this instance, the material making up the second portion 16 is of a higher tactility than that making up the first portion 14.

The higher tactility of the first portion 14 may be measured through a "subjective" tactility test. In this manner, a user of the glove 10 will be more easily able to feel through the second portion 16 than the first portion 14, hence indicating that the second portion 16 is of a higher tactility. Additionally or alternatively, an "objective" tactility standard may be used in order to provide the glove 10 with the portions 14, 16 of different tactility. For example, the deformation stress of the second portion 16 may be less than the first portion 14 when both the first and second portions 14, 16 are stretched to some degree, for example 500% elongation. The first portion 14 may have a higher stress at a certain percentage of elongation than the second portion 16.

The second portion 16 may have a tactility of any degree higher than the first portion 14. The second portion 16 may have twice the tactility as the first portion 14. Alternatively, the second portion 16 may have one and half times, three times, four times, or five times the tactility of the first portion 14 in accordance with other exemplary embodiments of the invention.

The second portion 16 may be less than about 3 mil in thickness, and the first portion 14 may be from about 3 mil to about 15 mil in thickness. More specifically, the second portion 16 may be 3 mil in thickness and the first portion 14 may be 5.5 mil in thickness in accordance with one exemplary embodiment.

The first portion 14 and/or the second portion 16 may be made of various materials in accordance with different exemplary embodiments of the present. For instance, the first portion 14 may be made of nitrile, a natural rubber such as latex, synthetic rubber, silicone, polyurethane, polypropylene, neoprene, nitrite butyl rubber, and/or a thermal plastic/elastomer in accordance with various exemplary embodiments. In one exemplary embodiment, the first portion 14 is made of natural rubber latex, and the second portion 16 is made of polypropylene.

The first portion 14 and/or second portion 16 may be formed from any variety of synthetic or natural polymeric elastomeric materials known in the art. In accordance with certain exemplary embodiments of the present invention, the first and second portions 14, 16 may be made from an aqueous-based polymer. Examples of aqueous-based polymers include natural rubber latex, nitrile polymers, polyurethane polymers, acrylic polymers, and the like. Nitrile polymers may be any film-forming polymer that contains acrylonitrile.

In accordance with one exemplary embodiment of the present invention, the glove 10 may be made from natural rubber latex, which is a naturally occurring emulsion of rubber and water with added stabilizing agents and vulcanizing chemicals. A form of appropriate shape is dipped into a mixture of the natural rubber latex, either once, or repeatedly to build up a layer to the desired thickness. Water in the coating is allowed to evaporate, leaving a solid rubber film. The film may be further vulcanized to provide adequate mechanical and physical properties. Natural rubber'latex provides for a desirable tactility of the glove 10 due to its low deformation stress at 10–500% elongations, and its high elastic recovery from these elongations.

The glove 10 of the present invention may also be formed from an elastomer liquid solution, which provides for a high tactility of the glove by exhibiting low deformation stress at 50–500% elongation. The elastomer liquid solution includes a block copolymer component that is made up of at least two, and preferably three, S-EB-S (styrene-ethylene-butylene-styrene) triblock copolymers that each have different solution viscosity/copolymer concentration values. A plasticizer is also included in the elastomer liquid solution and is selected in order to provide tactility in dipped formed products made from the composition. Additionally, a solvent is present in the elastomer liquid solution and is selected in an amount sufficient to form a stable solution of the block copolymer and the plasticizer, and to permit dip forming of products from the liquid solution. In one instance, the plasticizer is provided in an amount sufficient to reduce the deformation stress of the solid formed elastomer to less than about 5.5 MPa at 500% elongation. Such an elastomer liquid solution and glove 10 formed thereby is described in U.S. Pat. No. 5,112,900 issued to Buddenhagen et al., the entire contents of which are incorporated by reference herein in their entirety for all purposes.

Other suitable elastomeric materials which may be used to form the first and/or second portions 14, 16 include SIS (styrene-isopryene-styrene) block copolymers, S-BS (styrene-butadiene-styrene) block copolymers, S-I (styrene-isopryene) block copolymers, S-B (styrene-butadiene) block copolymers, and combinations thereof.

It should be understood that the present invention includes various modifications that can be made to the exemplary embodiments of the glove 10 as described herein as come within the scope of the appended claims and their equivalents.

What is claimed is:

1. A protective glove configured to cover the hand of a user, comprising:

a first portion configured for tightly fitting on at least a portion of the hand of the user, said first portion made of a first material that directly contacts said portion of the user's hand; and a second portion made of a different material than said first portion and attached to said first portion in at least one finger stall of said glove to directly contact the user's finger tip, said second portion circumscribed by said first portion at a finger tip of said finger stall so as not to extend completely around said finger stall, wherein the second portion has a higher tactility than the first portion such that the user may more easily feel through the second portion than through the first portion.

2. The protective glove as set forth in claim 1, wherein:

the first portion is configured to cover the palm, the back of the hand, the pinky finger, the ring finger, the middle finger, and the thumb of the user;

the second portion is disposed at the finger tip of the index finger of the user; and the first portion is configured to cover the rest of the index finger of the user not covered by the second portion.

3. The protective glove as set forth in claim 1, wherein:

the second portion is disposed at the finger tips of a plurality of finger stall; and the first portion is configured to cover the rest of the hand of the user.

4. The protective glove as set forth in claim 1, wherein:

the second portion is disposed at the finger tips of all of the finger stalls and thumb; and the first portion is configured to cover the rest of the hand of the user.

5. The protective glove as set forth in claim 1, wherein the second portion is made of polypropylene.

6. The protective glove as set forth in claim 1, wherein the first portion is made of a material selected from the group consisting of nitrile, natural rubber latex, silicone, polyurethane, and a thremoplastic/elastomer.

7. The protective glove as set forth in claim 1, wherein the second portion is thinner than the first portion.

8. The protective glove as set forth in claim 1, wherein:

the second portion is disposed at the finger tip of the thumb of the user and at a finger tip of at least one of the other fingers of the user; and the first portion is configured to cover the rest of the hand of the user.

* * * * *